US008950657B2

(12) United States Patent
Wagner

(10) Patent No.: US 8,950,657 B2
(45) Date of Patent: Feb. 10, 2015

(54) CARTON WITH HANDLE

(75) Inventor: Todd A. Wagner, Medina, OH (US)

(73) Assignee: Graphic Packaging International, Inc., Atlanta, GA (US)

( * ) Notice: Subject to any disclaimer, the term of this patent is extended or adjusted under 35 U.S.C. 154(b) by 469 days.

(21) Appl. No.: 13/281,750

(22) Filed: Oct. 26, 2011

(65) Prior Publication Data

US 2012/0104079 A1 May 3, 2012

Related U.S. Application Data

(60) Provisional application No. 61/456,114, filed on Nov. 1, 2010.

(51) Int. Cl.

| | |
|---|---|
| ***B65D 5/468*** | (2006.01) |
| ***B65D 5/72*** | (2006.01) |
| ***B65D 5/02*** | (2006.01) |
| ***B65D 5/46*** | (2006.01) |

(52) U.S. Cl.

CPC ..... *B65D 5/0227* (2013.01); *B65D 5/46024* (2013.01); *B65D 5/4608* (2013.01)

USPC ..... 229/117.11; 229/117.13; 229/117.24; 229/219; 229/243

(58) Field of Classification Search

CPC ..... B65D 5/46024; B65D 5/46096; B65D 5/46088; B65D 5/544

USPC ..... 229/117.11, 117.13, 117.14, 117.22, 229/117.24, 109

See application file for complete search history.

(56) References Cited

U.S. PATENT DOCUMENTS

| | | | | |
|---|---|---|---|---|
| 1,150,105 | A | | 8/1915 | Emmons |
| 2,111,376 | A | | 3/1938 | Van Wingen |
| 2,151,472 | A | | 3/1939 | Hubbard |
| 2,196,502 | A | | 4/1940 | Kells |
| 2,308,050 | A | | 1/1943 | Burr |
| 2,330,699 | A | | 9/1943 | Flamm |
| 2,386,905 | A | | 10/1945 | Meitzen |
| 2,611,527 | A | | 9/1952 | Fisher |
| 2,648,484 | A | | 8/1953 | Belsinger |
| 2,711,281 | A | | 6/1955 | Argodale |
| 2,900,123 | A | | 8/1959 | Drnec et al. |
| 3,054,549 | A | * | 9/1962 | Humphrey ..... 229/117.13 |
| 3,144,130 | A | | 8/1964 | Copping |

(Continued)

FOREIGN PATENT DOCUMENTS

| | | |
|---|---|---|
| DE | 2 159 258 | 6/1973 |
| EP | 08 706 88 A1 | 10/1998 |

(Continued)

OTHER PUBLICATIONS

International Search Report and Written Opinion for PCT/US2011/057808 mailed May 7, 2012.

*Primary Examiner* — Gary Elkins

(74) *Attorney, Agent, or Firm* — Womble Carlyle Sandridge & Rice, LLP

(57) ABSTRACT

A carton for containing and dispensing flowable materials. The carton comprises a plurality of panels that extends at least partially around an interior of the carton. The plurality of panels can comprise a front panel, a back panel, a first side panel, and a second side panel. At least one bottom flap is respectively foldably connected to a respective panel of the plurality of panels. The at least one bottom flap can at least partially form a closed bottom end of the carton. A handle can extend in at least the bottom end proximate the back panel.

21 Claims, 8 Drawing Sheets

(56) References Cited

U.S. PATENT DOCUMENTS

| | | | | | |
|---|---|---|---|---|---|
| 3,173,596 | A | | 3/1965 | Aust et al. | |
| 3,349,986 | A | * | 10/1967 | Chapman et al. | 229/117.13 |
| 3,425,544 | A | | 2/1969 | Ayer et al. | |
| 3,512,697 | A | * | 5/1970 | Robinson | 229/109 |
| 3,747,750 | A | | 7/1973 | Chapman | |
| 3,756,499 | A | | 9/1973 | Giebel et al. | |
| 3,897,873 | A | | 8/1975 | Graser | |
| 3,923,234 | A | * | 12/1975 | Lund, Jr. | 229/109 |
| 4,005,815 | A | | 2/1977 | Nerenberg et al. | |
| 4,029,207 | A | | 6/1977 | Gordon | |
| 4,538,759 | A | | 9/1985 | Dutcher | |
| 4,621,766 | A | | 11/1986 | McClure | |
| 4,747,486 | A | | 5/1988 | Benno | |
| 4,754,879 | A | | 7/1988 | Benno | |
| 5,072,876 | A | | 12/1991 | Wilson | |
| 5,119,985 | A | | 6/1992 | Dawson et al. | |
| 5,201,412 | A | | 4/1993 | Schuster et al. | |
| 5,350,109 | A | | 9/1994 | Brown et al. | |
| 5,402,933 | A | | 4/1995 | Behrmann | |
| 5,445,262 | A | | 8/1995 | Sutherland | |
| 5,518,174 | A | * | 5/1996 | Botterman | 229/207 |
| 5,588,585 | A | | 12/1996 | McClure | |
| 5,775,503 | A | | 7/1998 | LeBras | |
| 5,813,540 | A | | 9/1998 | Vollbrecht et al. | |
| 6,045,036 | A | * | 4/2000 | Ring | 229/117.13 |
| 6,065,590 | A | | 5/2000 | Spivey | |
| 6,112,977 | A | | 9/2000 | Sutherland et al. | |
| 6,170,741 | B1 | | 1/2001 | Skolik et al. | |
| 6,250,542 | B1 | | 6/2001 | Negelen | |
| 6,402,020 | B1 | | 6/2002 | McClure | |
| 6,595,411 | B2 | | 7/2003 | McClure | |
| 6,631,803 | B2 | | 10/2003 | Rhodes et al. | |
| 6,705,515 | B2 | | 3/2004 | Dowd | |
| 6,766,940 | B2 | | 7/2004 | Negelen | |
| 6,848,573 | B2 | | 2/2005 | Gould et al. | |
| 6,926,193 | B2 | | 8/2005 | Smalley | |
| 6,968,992 | B2 | | 11/2005 | Schuster | |
| 7,726,503 | B2 | * | 6/2010 | Dygert et al. | 229/117.35 |
| 7,757,933 | B2 | | 7/2010 | Dunn | |
| 7,775,418 | B2 | | 8/2010 | Walling | |
| 7,780,067 | B2 | | 8/2010 | Holley, Jr. | |
| 7,793,779 | B2 | | 9/2010 | Spivey, Sr. et al. | |
| 7,832,622 | B2 | | 11/2010 | Spivey, Sr. | |
| 7,998,047 | B2 | | 8/2011 | Spivey, Sr. et al. | |
| 2003/0080180 | A1 | | 5/2003 | Holley et al. | |
| 2005/0067477 | A1 | | 3/2005 | McClure | |
| 2005/0087592 | A1 | | 4/2005 | Schuster | |
| 2005/0189405 | A1 | | 9/2005 | Gomes et al. | |
| 2005/0263574 | A1 | | 12/2005 | Schuster | |
| 2006/0081691 | A1 | | 4/2006 | Smalley | |
| 2006/0180643 | A1 | * | 8/2006 | Stephenson | 229/117.3 |
| 2006/0278689 | A1 | | 12/2006 | Boshinski et al. | |
| 2007/0063003 | A1 | | 3/2007 | Spivey et al. | |
| 2007/0108261 | A1 | | 5/2007 | Schuster | |
| 2007/0131748 | A1 | | 6/2007 | Brand | |
| 2007/0170232 | A1 | | 7/2007 | Spivey | |
| 2010/0025457 | A1 | | 2/2010 | Cooper et al. | |
| 2010/0102112 | A1 | | 4/2010 | Ouillette | |

FOREIGN PATENT DOCUMENTS

| | | |
|---|---|---|
| JP | 3-84717 | 8/1991 |
| JP | 03-113332 U | 11/1991 |
| JP | 2006-008216 A | 1/2006 |
| WO | WO 99/28198 | 6/1999 |

* cited by examiner

CARTON WITH HANDLE

CROSS-REFERENCE TO RELATED APPLICATIONS

This application claims the benefit of U.S. Provisional Patent Application No. 61/456,114, filed Nov. 1, 2010.

INCORPORATION BY REFERENCE

The disclosure of U.S. Provisional Patent Application No. 61/456,114, which was filed on Nov. 1, 2010, is hereby incorporated by reference for all purposes as if presented herein in its entirety.

BACKGROUND OF THE DISCLOSURE

The present disclosure generally relates to cartons for holding and dispensing contents such as powders, granular materials, and other flowable materials. More specifically, the present disclosure relates to cartons having a handle in at least a bottom corner of the carton.

SUMMARY OF THE DISCLOSURE

In general, one aspect of the disclosure is directed to a carton for containing and dispensing flowable materials. The carton comprises a plurality of panels that extends at least partially around an interior of the carton. The plurality of panels can comprise a front panel, a back panel, a first side panel, and a second side panel. At least one bottom flap is respectively foldably connected to a respective panel of the plurality of panels. The at least one bottom flap can at least partially form a closed bottom end of the carton. A handle can extend in at least the bottom end proximate the back panel.

In another aspect, the disclosure is generally directed to a blank for forming a carton. The blank can comprise a plurality of panels comprising a front panel, a back panel, a first side panel, and a second side panel. At least one bottom flap can be respectively foldably connected to a respective panel of the plurality of panels. The at least one bottom flap can be for at least partially forming a closed bottom end of the carton formed from the blank. The blank fan further include handle features in at least the at least one bottom flap for forming a handle extending in at least the bottom end proximate the back panel in the carton formed from the blank.

In another aspect, the disclosure is generally directed to a method of forming a carton. The method can comprise obtaining a blank comprising a plurality of panels comprising a front panel, a back panel, a first side panel, and a second side panel, at least one bottom flap respectively foldably connected to a respective panel of the plurality of panels, and handle features in at least the at least one bottom flap. The method can also include forming an interior of the carton at least partially defined by the plurality of panels. The forming the interior of the carton can comprise forming an open-ended sleeve. The method can further include positioning the at least one bottom flap to at least partially close a bottom end of the open-ended sleeve. The positioning the at least one bottom flap can comprise positioning the handle features to form a handle adjacent the back panel.

Those skilled in the art will appreciate the above stated advantages and other advantages and benefits of various additional embodiments reading the following detailed description of the embodiments with reference to the below-listed drawing figures.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons with features for containing and facilitating dispensing articles such as flowable materials, liquids, powders, etc. The articles can include, but are not limited to, particulates, granular materials, powders, and the like, or any combination thereof. Examples of such materials include, but are not limited to, rice, beans, sugar, flour and other flowable solid products, such as cat litter, sand, soaps, and detergents. In this specification, the terms "lower," "bottom," "upper" and "top" indicate orientations determined in relation to fully erected and upright cartons.

Figure 1:
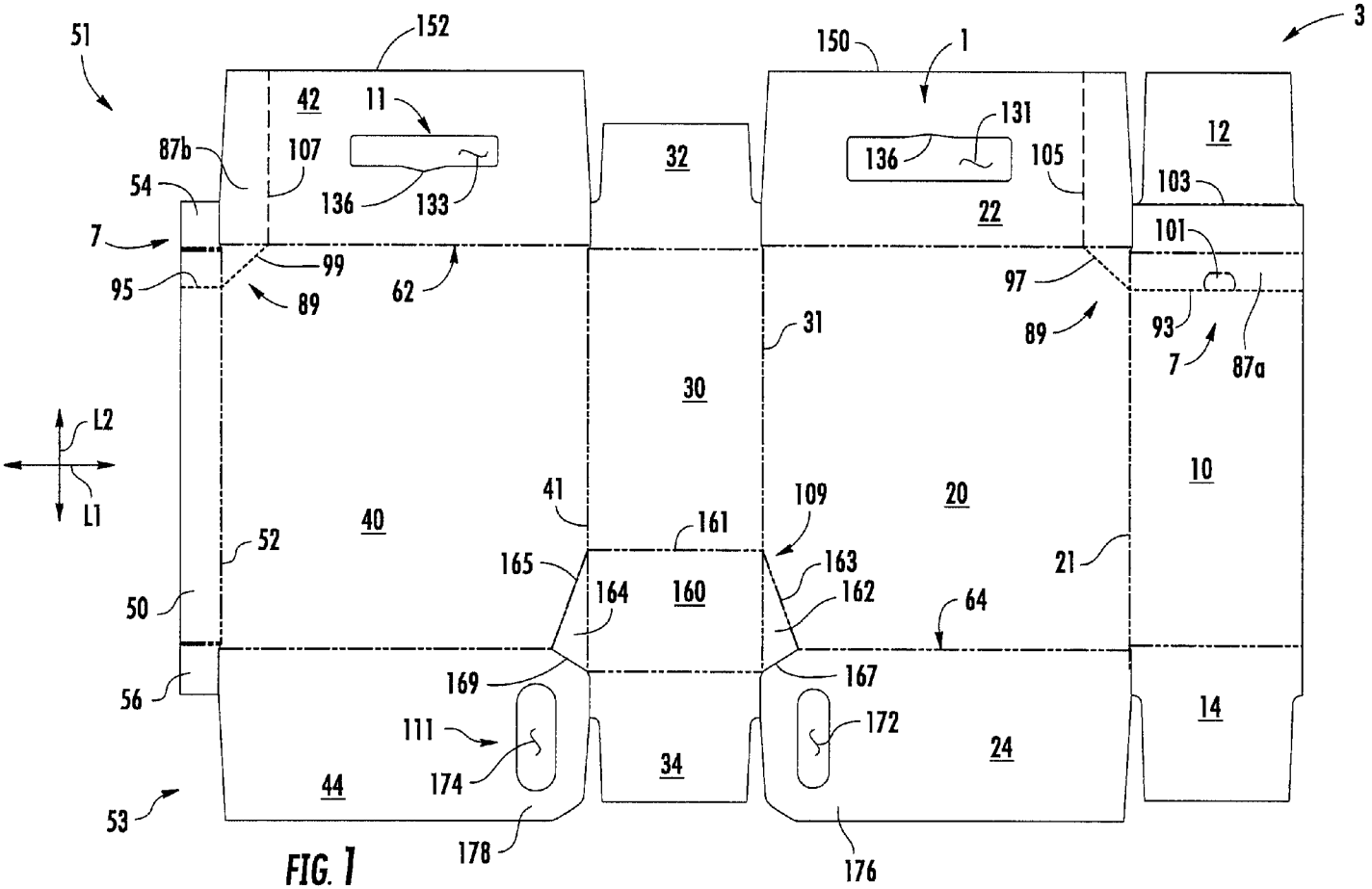
FIG. 1 is an exterior plan view of a carton blank used to form a carton in accordance with one aspect of the disclosure.
Figure 2:
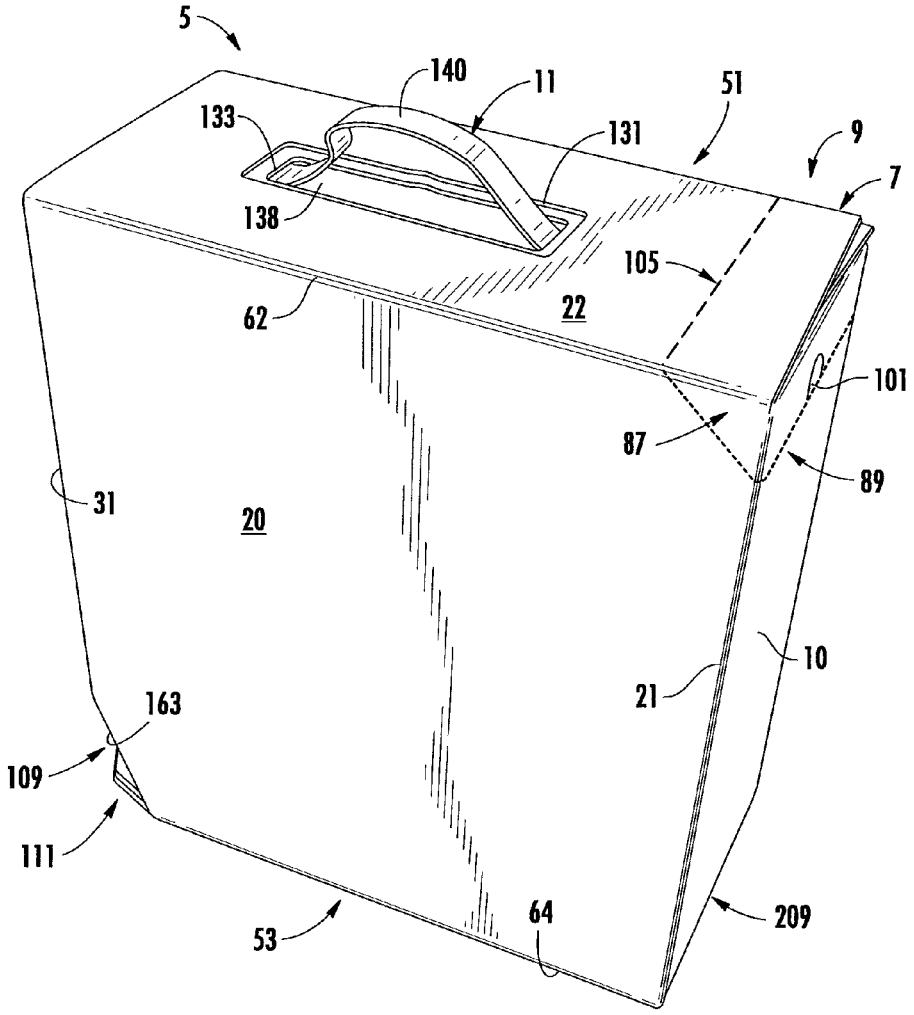
FIGS. 2 and 3 are perspective views showing the assembled carton.
Figure 3:
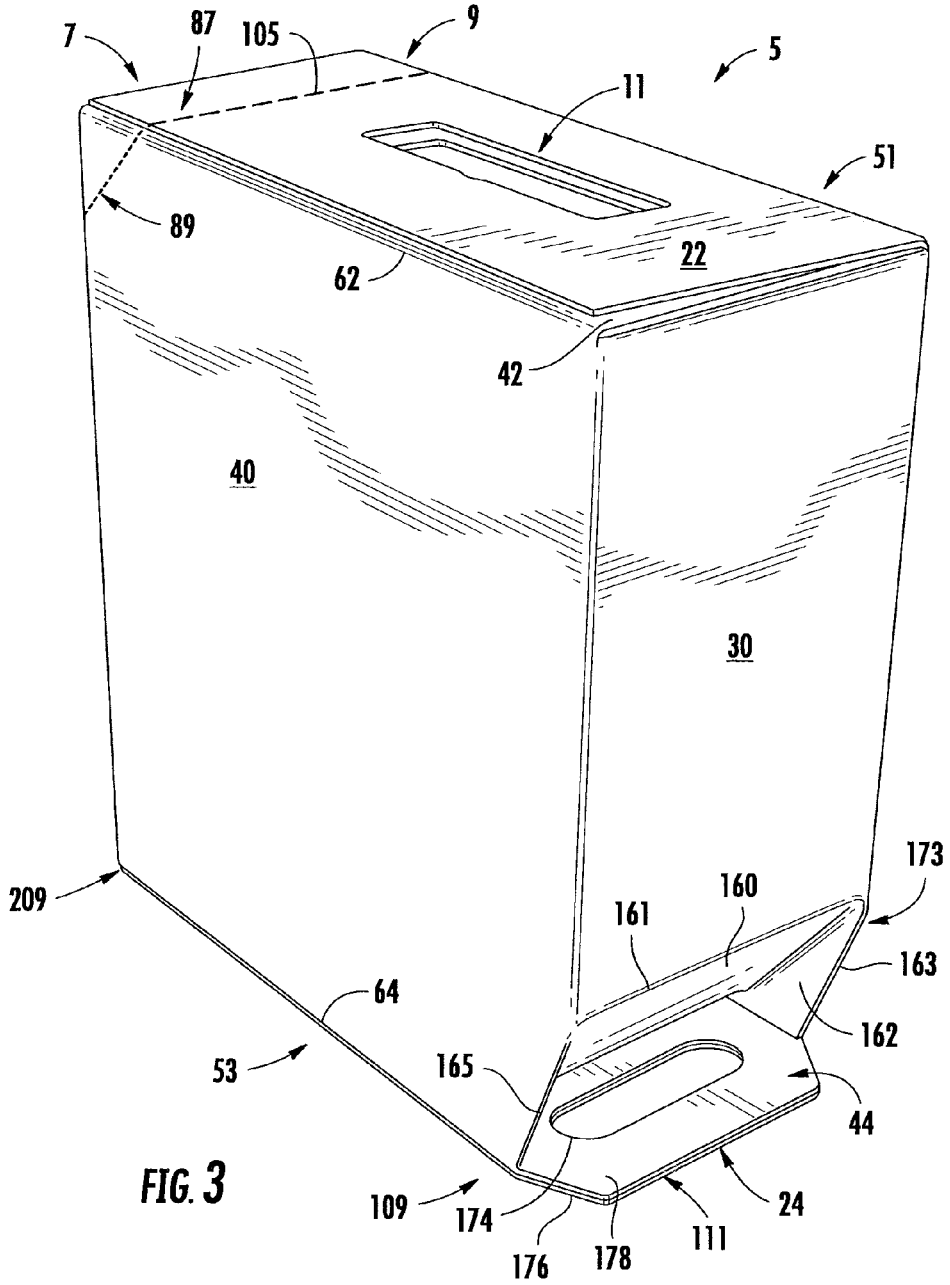
Figure 7:
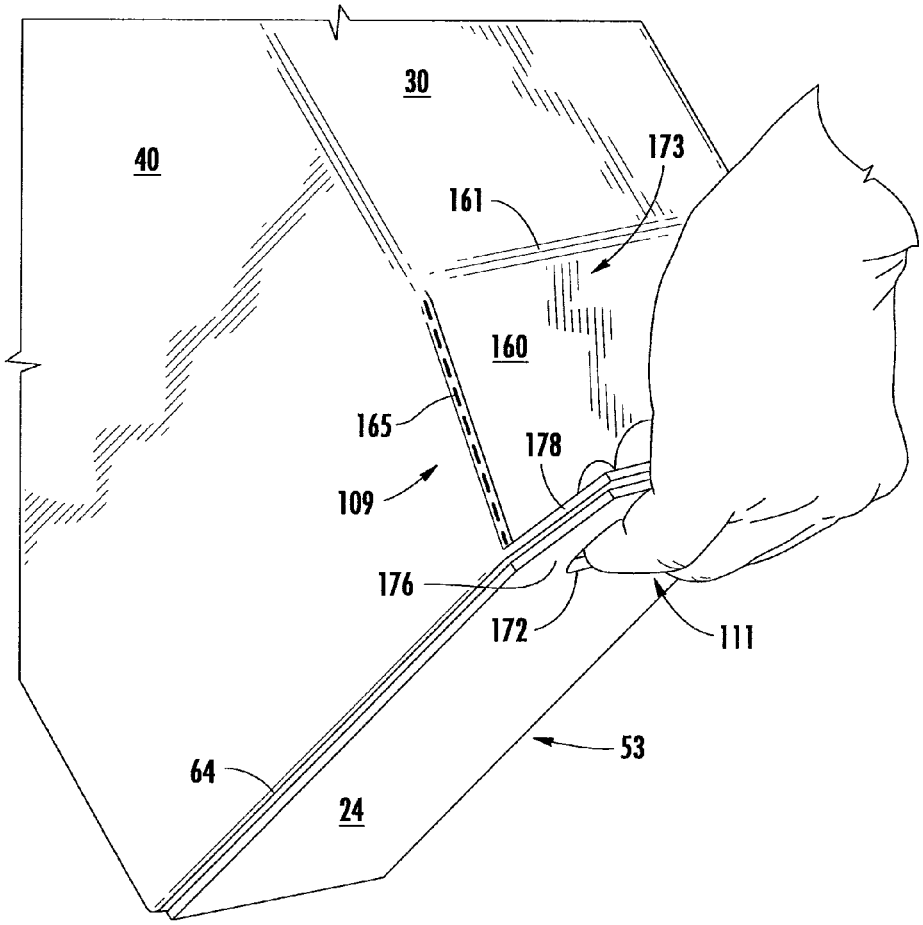

FIG. 1 is a plan view of the exterior side 1 of a blank, generally indicated at 3, used to form a carton 5 (FIGS. 2 and 3) according to the exemplary embodiment of the disclosure. The carton 5 can be used to house flowable materials or other articles. The carton 5 has a dispenser, generally indicated at 7 (FIGS. 2 and 4), formed in the carton at a dispensing corner 9 for allowing access to the flowable materials. In the illustrated embodiment, the carton 5 is sized to contain 28 pounds of flowable material, but it is understood that the carton 5 may be sized and shaped to hold contents of a different quantity. In the illustrated embodiment, the carton 5 includes a top handle, generally indicated at 11, for grasping and carrying the carton at a top end 51 of the carton (FIG. 2), and a bottom or corner handle 111 at an angled corner 109 of a bottom end 53 (FIGS. 3 and 7). As will be discussed below in more detail, the handles 11, 111 are formed from various features in the blank 3. In one embodiment, the blank 3 can be formed of paperboard, corrugated cardboard, or other materials, or combinations thereof.

The carton blank 3 has a longitudinal axis L1 and a lateral axis L2. In the illustrated embodiment, the blank 3 comprises a front panel 10 foldably connected to a first side panel 20 at a first lateral fold line 21. A back panel 30 is foldably connected to the first side panel 20 at a second lateral fold line 31. A second side panel 40 is foldably connected to the back panel 30 at a third lateral fold line 41. In the illustrated embodiment, the blank 3 includes an attachment panel 50 foldably connected to the second side panel 40 at a fourth lateral fold line 52. Alternatively, the attachment panel 50 could be connected to the front panel 10 or omitted without departing from the disclosure.

Figure 6:
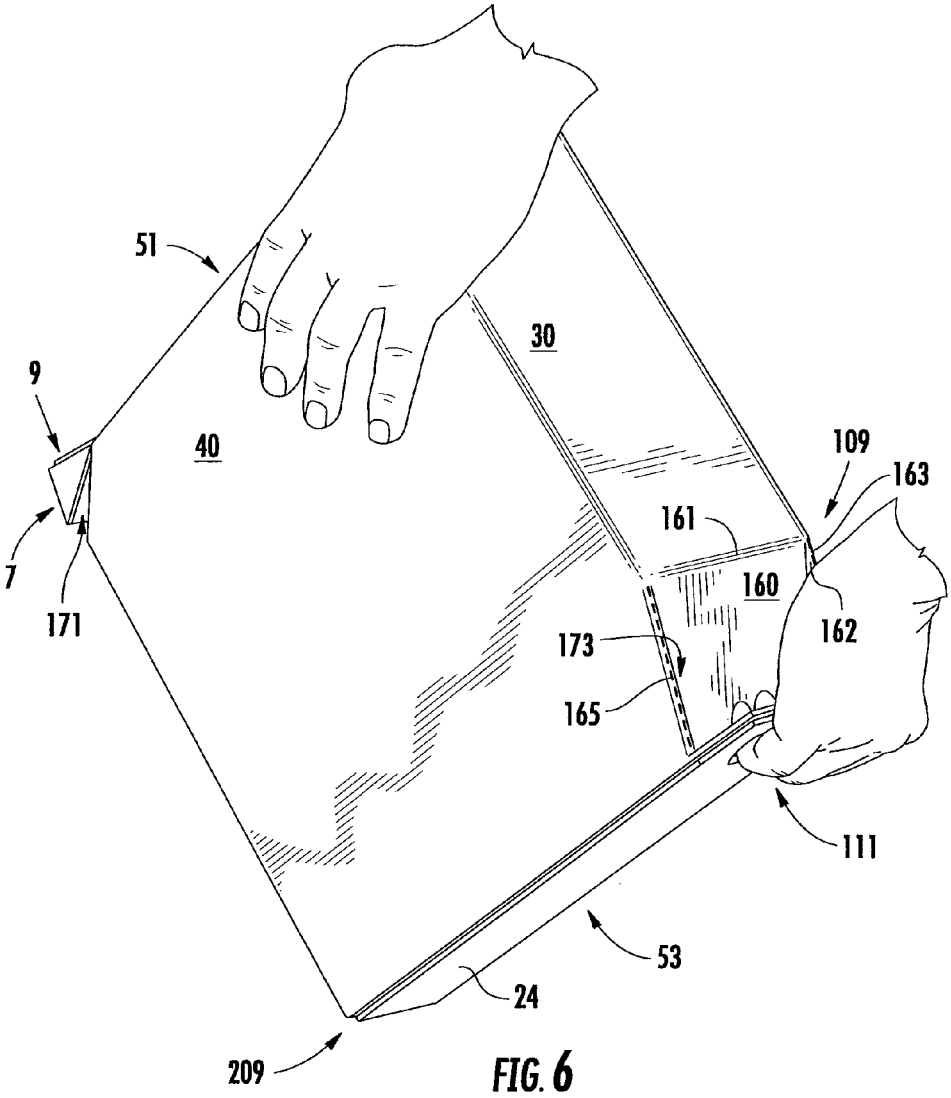
FIGS. 6 and 7 are perspective views of the carton in a pouring position.

The front panel 10 is foldably connected to a front top flap 12 and a front bottom flap 14. The first side panel 20 is foldably connected to a first side top flap 22 and a first side bottom flap 24. The back panel 30 is foldably connected to a back top flap 32 and a back bottom flap 34. The second side panel 40 is foldably connected to a second side top flap 42 and a second side bottom flap 44. The attachment panel 50 is foldably connected to an attachment top flap 54 and an attachment bottom flap 56. When the carton 5 is erected, the front and back top flaps 12, 32, side top flaps 22, 42, and attachment top flap 54 close a first (e.g., top) end 51 of the carton, and the front and back bottom flaps 14, 34, side bottom flaps 24, 44, and attachment bottom flap 56 and close a second (e.g., bottom) end 53 of the carton (FIG. 6). In accordance with an alternative embodiment of the present disclosure, different flap arrangements can be used for at least partially closing the top and bottom ends 51, 53 of the carton 5, or any of the flaps can be omitted without departing from the disclosure.

The front and back top flaps 12, 32, side top flaps 22, 42, and attachment top flap 54 extend along a first marginal area of the blank 3, and are foldably connected at a first longitudinal fold line 62 that extends along the length of the blank. The front and back bottom flaps 14, 34, side bottom flaps 24, 44, and attachment bottom flap 56 extend along a second marginal area of the blank 3, and are foldably connected at a second longitudinal fold line 64 that also extends along the length of the blank, though the longitudinal fold line 64 can be interrupted by cut lines as described below. The longitudinal fold lines 62, 64 may be, for example, substantially straight, or offset at one or more locations to account for blank thickness or for other factors.

As shown in FIG. 1, the dispenser 7 includes a dispenser panel 87 (FIGS. 2 and 4) having a first portion 87*a* formed in the front panel 10, the first side panel 20, the front top flap 12, and the first side top flap 22. The dispenser panel 87 further includes a second portion 87*b* formed in the attachment panel 50, the second side panel 40, the attachment top flap 54, and the second side top flap 42. The dispenser panel 87 is at least partially separable from the carton 5 along a tear feature, generally indicated at 89, to form a dispenser opening 171 (FIGS. 3 and 4) in the carton. In the illustrated embodiment, the tear feature 89 includes a first tear line 93 extending in the front panel 10 in the longitudinal direction L1 and a second tear line 95 extending in the attachment panel 50 in the longitudinal direction L1. The tear feature 89 can include a first oblique tear line 97 extending in the first side panel 20 from an end of the first tear line 93 to the first longitudinal fold line 62 and a second oblique tear line 99 extending obliquely in the second side panel 40 from an end of the second tear line 95 to the first longitudinal fold line 62. In one embodiment, an access feature 101 can be included in the front panel 10 adjacent the first tear line 93 for initiating opening of the dispenser 7. The access feature 101 can extend in the dispenser panel 87, or outside the dispenser panel, and the access feature can comprise an access flap or opening. Alternatively, the access feature can be omitted. Further, the tear feature 89 can be alternatively configured or omitted without departing from the present disclosure. For example, the tear feature could include one or more tear strips or cut lines.

In the illustrated embodiment, the dispenser panel 87 is further defined by a first dispenser fold line 103 extending in the front top flap 12, a second dispenser fold line 105 extending in the first side top flap 22, and a third dispenser fold line 107 extending in the second side top flap 42. The dispenser fold lines 103, 105, 107 are disposed so that the dispenser fold lines are aligned and overlapped when the top end 51 is closed (FIG. 2). In one embodiment, each of the dispenser fold lines 103, 105, 107 comprises a cut-crease-style line. Alternatively, one or more of the dispenser fold lines 103, 105, 107 can at least partially comprise one or more tear lines or tear features, or one or more of the dispenser fold lines can be a different style of fold line than the other dispenser fold lines. Further, one or all of the dispenser fold lines 103, 105, 107 can be omitted without departing from the scope of the disclosure.

As shown in FIG. 1, the first dispenser fold line 103 extends from a cut extending between the front top flap 12 and the first side top flap 22 to a free edge of the front top flap extending in the lateral direction L2 of the blank 3. The second dispenser fold line 105 extends from an end of the first oblique tear line 97 at the first longitudinal fold line 62 to a free edge 150 of the first side top flap 22 that extends in the longitudinal direction L1 of the blank 3. Similarly, the third dispenser fold line 107 extends from an end of the second oblique tear line 99 at the first longitudinal fold line 62 to a free edge 152 of the second side top flap 42 that extends in the longitudinal direction L1 of the blank 3. Accordingly, the first portion 87*a* of the dispenser panel 87 is defined by the tear lines 93, 97 in the respective panels 12, 20 and the fold lines 103, 105 in the respective top flaps 12, 22. The second portion 87*b* of the dispenser panel 87 is defined by the tear lines 95, 99 in the respective panels 50, 40 and the fold line 107 in the second side top flap 42.

The dispenser 7 may be otherwise sized, shaped, and/or located in the carton 5 without departing from the scope of this disclosure. For example, the dispenser panel 87 might extend in only one of the first and second side panels 20, 40, only partially across the front panel 10 in the longitudinal direction L1, or a combination thereof. Further, the dispenser 7 may be omitted from the carton 5 without departing from the scope of the disclosure.

Figure 5A:
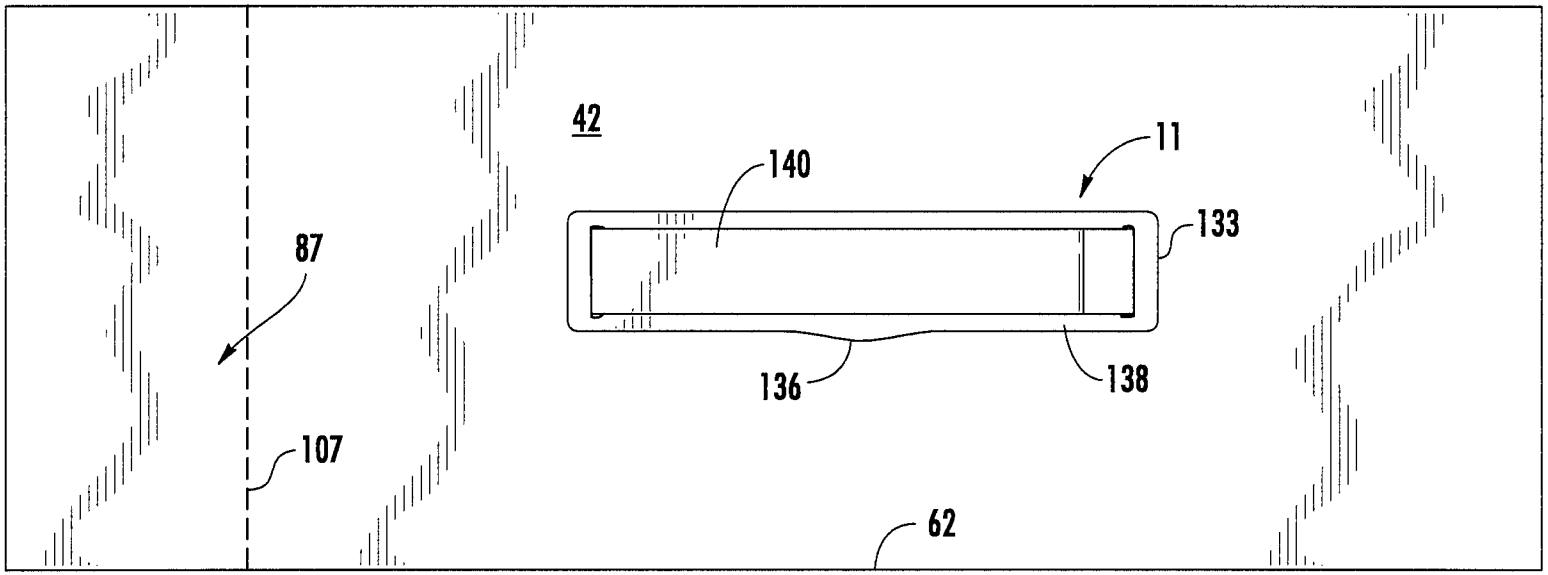
FIG. 5A is a top view of the carton of FIGS. 2 and 3 showing a top handle.
Figure 5B:
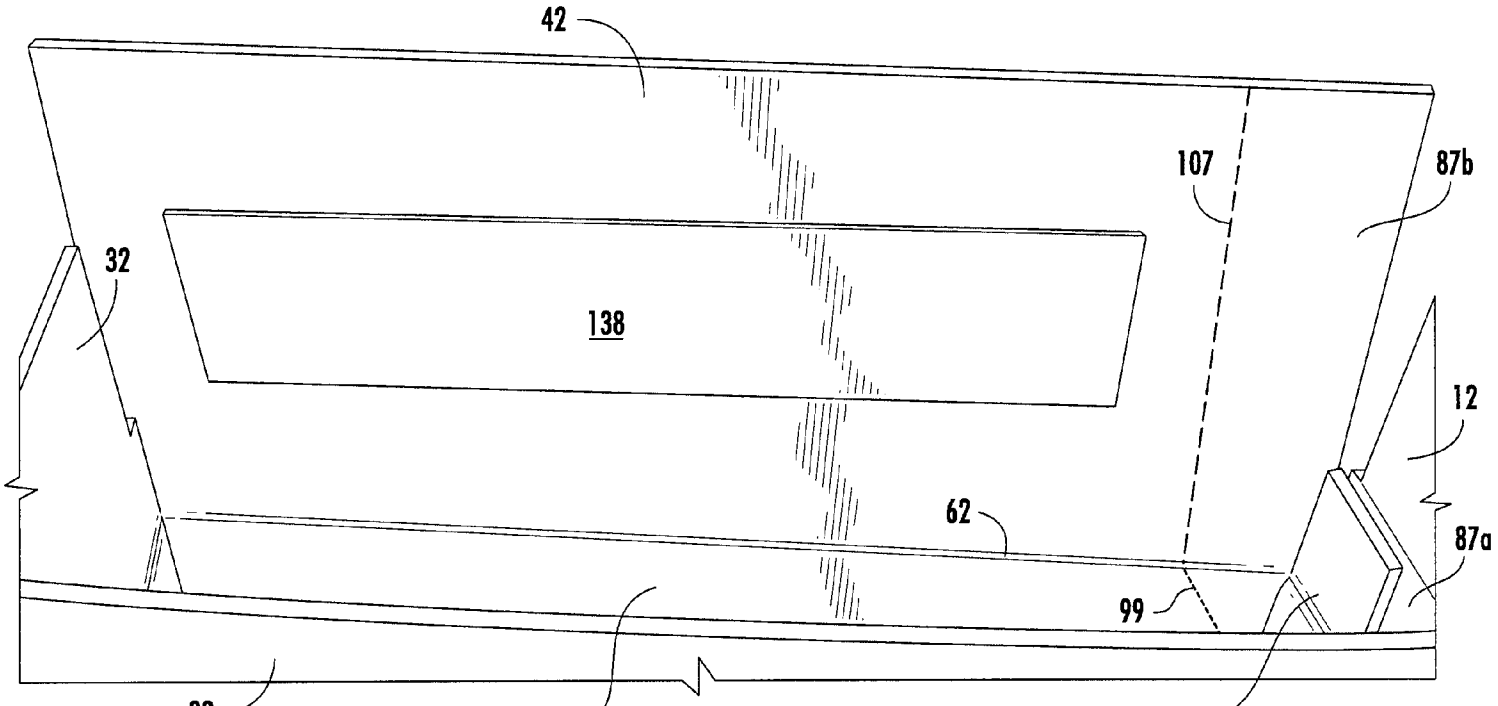
FIG. 5B is an interior view of a top flap of the carton showing a portion of the top handle of FIG. 5A prior to closing of the top end of the carton.

As shown in FIG. 1, the features that form the top handle 11 of the carton 5 include an elongate, generally rectangular first top handle opening 131 formed in the first side top flap 22 and an elongate, generally rectangular second top handle opening 133 formed in the second side top flap 42. In the illustrated embodiment, the features of the top handle 11 include curved or angled portions 136 for allowing finger access to the handle strip. The top handle features further include a handle panel 138, which can be secured to the interior surface of the second side top flap 42 (FIG. 5B). As shown in FIG. 5A, a handle strip 140 can be secured to the handle panel 138 at each end of the handle strip 140. In a particular embodiment, the handle panel 138 can be two-ply so that the ends 142 of the handle strip 140 extend through respective openings in the upper ply of the handle panel 138. Accordingly, the ends are secured between the two plies of the handle panel. The handle strip 140 can include two or more creases so that the handle strip 140 can lay generally flat against the upper ply of the handle panel until activated by a user. When the top end 51 of the carton 5 is closed, the handle strip 140 extends longitudinally within the top handle openings 131, 133 for grasping of the top handle 11.

The top handle 11 can be otherwise shaped and located in the carton 5 without departing from the scope of this disclosure. For example, the top handle openings 131, 133 and the handle strip 140 can extend laterally or obliquely in the side top flaps 22, 42. Further, the handle panel 138 can be secured to either of the side top flaps 22, 42, and it can be secured to the innermost surface or the outermost surface of the top end 51. Alternatively, the handle panel 138 can be disposed between the overlapping side top flaps 22, 42. In another example, the top handle 11 could be formed by two or more spaced-apart openings formed in the top end 51. Further, the top handle 11 can be omitted without departing from the scope of the present disclosure.

In the illustrated embodiment, a corner handle 111 is formed at an angled corner 109 of the carton 5. The angled corner 109 includes and is formed by an oblique or lower portion 160 of the back panel 30 and triangle portions 162, 164 of the respective first and second side panels 20, 40. The lower portion 160 is defined by at least a longitudinal crease or other line of weakening 161 and the longitudinal fold line 64. The triangle portion 162 is foldably connected to the lower portion 160 by the lateral fold line 31 and is defined by at least an oblique fold line 163 extending in the first side panel 20. The triangle portion 164 is foldably connected to the lower portion 160 by the lateral fold line 41 and is defined by at least an oblique fold line 165 extending in the second side panel 40. The triangle portions 162, 164 are separated from the respective side bottom flaps 24, 44 along respective cuts 167, 169, which can interrupt the longitudinal fold line 64. The cuts 167, 169 could be other forms or lines of weakening (e.g., tear lines) without departing from the disclosure. As shown in FIG. 3, the angled corner 109 is formed in the assembled carton 5 by folding the triangle portions 162, 164 into face-to-face contact with the respective side panels 20, 40 so that the lower portion 160 extends obliquely from the longitudinal crease 161 to the portion of the longitudinal fold line 64 connecting the back bottom flap 34 to the back panel 30, which is inwardly offset from the portions of the longitudinal fold line 64 connecting the side bottom flaps 24, 44 to the respective side panels 20, 40. Accordingly, the lower portion 160 and the triangular portions 162, 164 form a generally wedge-shaped handle recess 173 at the angled corner 109 (FIG. 3).

The features of the corner handle 111 include corner handle openings 172, 174 formed in the respective handle portions 176, 178 in the respective side bottom flaps 24, 44. In the assembled carton 5, as shown in FIG. 3, the handle portions 176, 178 extend along the bottom of the wedge-shaped handle recess 173, external to the carton 5. Accordingly, the corner handle openings 172, 174 do not penetrate to the interior of the carton. Instead, the interior of the carton 5 remains intact below the dispenser 7 to prevent leaking of the contents of the carton, while the wedge-shaped handle recess 173 provides access to the corner handle openings 172, 174 at the angled corner 109. The corner handle 111 and the angled corner 109 can be alternatively configured or omitted without departing from the scope of the present disclosure.

In accordance with the exemplary embodiment, the carton blank 3 can be erected into the carton 5 by folding the carton blank 3 along fold lines 21, 31, 41, 52. The attachment panel 50 can be adhered to the interior surface of the front panel 10, and the adhesive flaps 54, 56 can be glued to the interior surfaces of the respective front flaps 12, 14, to form an open-ended sleeve. The bottom end 53 of the sleeve can be closed by respectively overlapping and adhering the front and back bottom flaps 14, 34 and side bottom flaps 24, 44. Particularly, the back bottom flap 34 is folded along the longitudinal fold line 64, and the lower portion 160 of the back panel 30 is folded along the longitudinal crease 161 while the triangular portions 162, 164 of the respective side panels 20, 40 are folded along respective fold lines 163, 165 into face-to-face contact with the respective side panels 20, 40. The front bottom flap 14 is folded inwardly along the longitudinal fold line 64, and the side bottom flaps 24, 44 are folded along the longitudinal fold line 64 to overlap the front and back bottom flaps 14, 34 so that the corner handle openings 172, 174 are generally aligned to form the corner handle 111. Accordingly, the bottom flaps 14, 24, 34, 44, 56 form the bottom end 53, the wedge-shaped handle recess 173 is formed at the angled corner 109, and the handle portions 176, 178 of the respective side bottom flaps 24, 44 extend along the bottom of the wedge-shaped handle recess 173. The overlapped handle portions 176, 178 provide a sturdy, tear-resistant handle 111. In the illustrated embodiment, the first side bottom flap 24 is external to the second side bottom flap 44; however, the second side bottom flap 44 can be configured to be external to the first side bottom flap 24 without departing from the scope of the present disclosure. In an alternative embodiment, only one of the side bottom flaps 24, 44 extends along the bottom of the wedge-shaped handle recess 173, and either handle portion 176, 178 is omitted.

The top end 51 can be closed and the top handle 11 can be formed by adhering the handle panel 138 to the interior surface of the second side top flap 42 so that the handle strip 140 extends through the handle opening 133 (FIGS. 5A and 5B). FIG. 5B shows the top of the sleeve with the handle panel 138 secured to the interior surface of the side top flap 42 with the handle strip 140 aligned with the handle opening 133. The front and back top flaps 12, 32 and the second side top flap 42 can be folded along the longitudinal fold line 62 and the second side top flap 42 can be adhered to the exterior surfaces of the front and back top flaps. The first side top flap 22 can be folded along the longitudinal fold line 62 to be in face-to-face contact with the second side top flap 42 with the first handle opening 131 of the first side top flap 22 generally aligned with the second handle opening 133 of the second side top flap 42. Accordingly, the handle strip 42 can be pulled upwardly through both of the handle openings 131, 133 (FIG. 2). Further, the second dispenser fold line 105 in the first side top panel 22 generally overlaps the third dispenser fold line 107 in the second side top panel 42, and the third dispenser fold line 107 generally overlaps the first dispenser fold line 103 in the front top panel 12. The top end 51 and the bottom end 53 can be alternatively closed without departing from the disclosure. For example, either the top end 51 or the bottom end 53 can be assembled first, leaving the other end open so that the contents of the carton 5 may be introduced into the container. The open end can then be closed after the contents are loaded into the carton 5.

The assembled carton 5 is shown in FIGS. 2, 3, 4, and 6 with the top handle 11 in the top end 51, the dispenser 7 disposed at the dispensing corner 9, and the corner handle 111 disposed at the angled corner 109. In the illustrated embodiment, the is dispenser 7 is disposed at an opposite corner from the corner handle 111, wherein the dispensing corner 9 is disposed at the top of the front panel 10, and the angled corner 109 is disposed at the bottom of the back panel 30. Alternative assembling, loading, and closing steps may be used without departing from the scope of the disclosure. For example, the carton blank 3 may be otherwise configured to have multiple front panels, multiple back panels, multiple side panels, or combinations thereof without departing from the scope of the disclosure.

The top handle 11 can be used to grasp the carton 5 for carrying by grasping the handle strip 140 and pulling it upwardly through the handle openings 133, 131. As it is pulled upwardly, the handle strip 140 can unfold and expand so that a user can easily grasp the top handle. It is understood that the top handle 11 can be omitted, the carton 5 can include more than one handle configured similarly to the top handle 11, or that the top handle 11 can be otherwise shaped, arranged, and/or located without departing from the disclosure.

Figure 4:
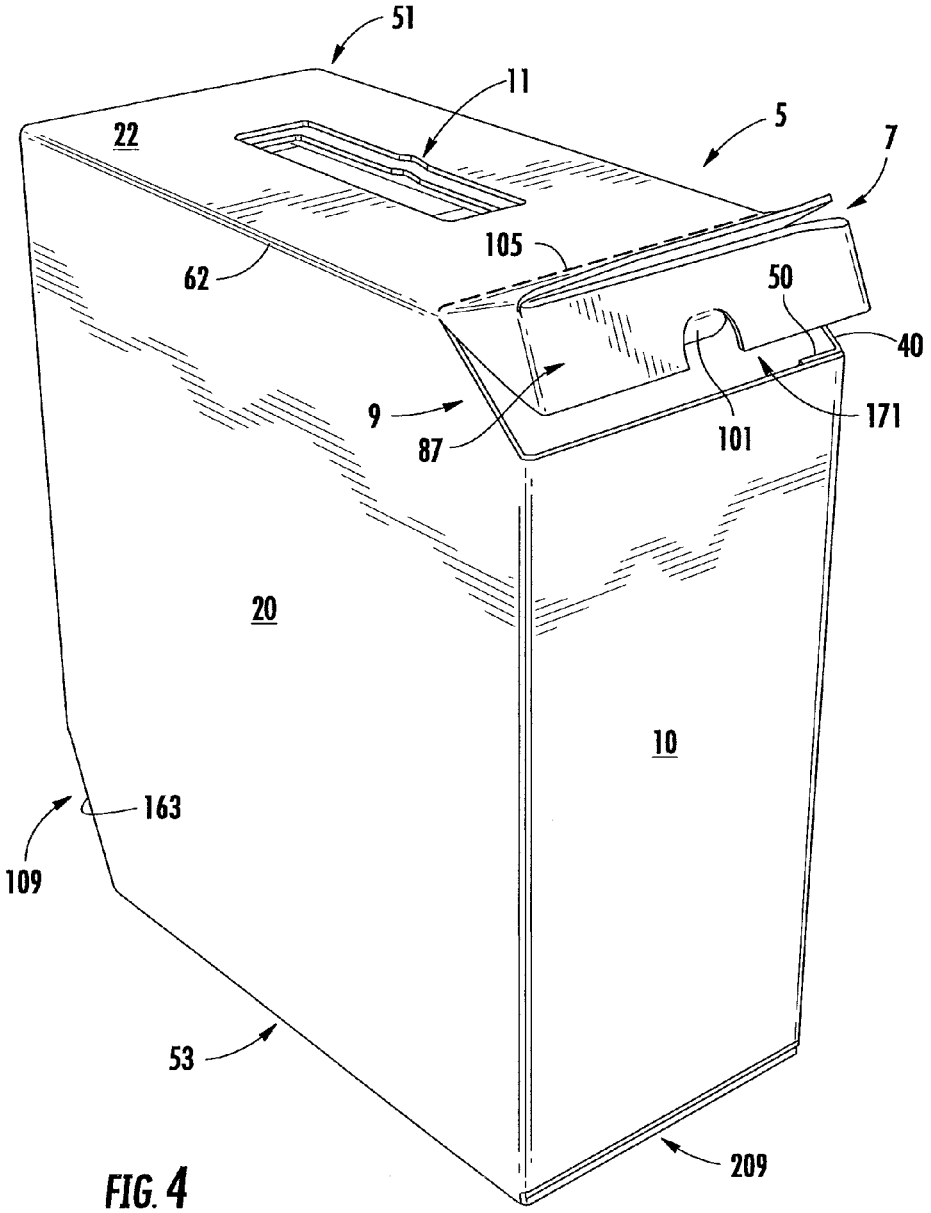
FIG. 4 is a perspective view showing the carton of FIGS. 2 and 3 with a dispenser in an open position.

As shown in FIG. 4, the carton 5 can be opened by actuating the dispenser 7 to create a dispenser opening 171 in the dispensing corner 9 of the carton. The dispenser 7 is opened by initiating tearing the tear feature 89 along the tear lines 93, 95 at the access feature 101. The dispenser panel 87, including the portions the front top panel 12, the front panel 10, side panels 20, 40, the attachment panel 50, and the side top flaps 22, 42, is pivoted upwardly along the overlapping dispenser fold lines 103, 105, 107 in the respective front top flap 12 and side top flaps 22, 42 to form the dispenser opening 171. The pivoting of the dispenser flap 87 tears the oblique tear lines 97, 99 in the respective side panels 20, 40. Other opening arrangements for the dispenser 7 can be provided.

The dispenser panel 87 extends laterally across the side top flaps 22, 42 to provide a convenient opener cavity at the dispenser opening 171 for access to the contents of the carton 5. A user can tip the carton 5 to pour contents through the dispenser opening 171, as desired. According to one embodiment, the carton 5 can be placed in a pouring position to pour out the contents of carton through the dispenser 7 as shown in FIGS. 6 and 7. Particularly, a user can grasp the carton at the corner handle 111 by extending the fingers of a first hand through the corner handle openings 172, 174. The fingers can extend upwardly through the corner handle openings into the wedge-shaped handle recess 173 as shown, or, alternatively, the user can insert the first hand through the wedge-shaped handle recess and extend the fingers downwardly through the corner handle openings.

In one embodiment, the user can grasp the carton 5 anywhere with the second hand to further support the carton during pouring. For example, the user could grasp the carton at the front panel or the top handle 11. Alternatively, the user can keep the second hand free by resting the carton 5 on a pivot corner 209 formed by the portion of the longitudinal fold line 64 connecting the front bottom flap 14 to the front panel 10. The user pulls the angled corner 109 upwardly at the corner handle 111, pivoting the carton about the pivot corner 209 to lower the dispensing corner 9 until a portion of the flowable material contained in the carton 5 pours out of the carton through the opening 171 at the dispenser 7. The user continues to pivot the carton about the pivot corner 209 until the desired amount of the flowable material is dispensed. The carton 5 can be alternatively pivoted for pouring without departing from the present disclosure. Further, the contents of the carton can be alternatively dispensed from the carton, such as by scooping through the opening 171.

Accordingly, the angled corner 109 provides access to the corner handle 111 and allows the corner handle to be outside the panels forming the interior of the carton without increasing the footprint of the carton. Stated another way, the angled corner 109 is configured so that the corner handle openings 172, 174 do not penetrate to the interior of the carton, while the corner handle 111 does not extend beyond the edges of the top end 51 of the carton. Alternatively, the corner handle 111 can be configured to protrude past the back panel 30 or the side panels 20, 40. Accordingly, the interior of the carton 5 remains intact below the dispenser 7 to prevent leaking of the contents of the carton, and the carton retains sift resistancy. Further, extended panels and flaps requiring additional material are not required, and the angled corner 109 allows the corner handle 111 to be formed without requiring that additional pieces be attached during manufacturing, assembly, or use.

In an alternative embodiment, the angled corner 109 and the corner handle 111 can be otherwise configured or disposed at any corner of the carton 5.

In one embodiment, a liner, a bag, a reinforcing tape, a reinforcing insert, or a combination thereof can be adhered to, or otherwise disposed within, the interior of the carton 5. Alternatively, the liner, bag, tape, or other insert can be disposed externally with respect to the carton. The liner, bag, tape, or other insert can be used to avoid tearing of the carton 5 and delamination of the panels and flaps of the carton, or to seal the interior of the carton top prevent leaking of the contents. Alternatively, no liner, bag, tape, or other insert is used, and the carton 5 is filled with flowable material or other items directly.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for containing and dispensing flowable materials, the carton comprising:

a plurality of panels that extends at least partially around an interior of the carton, the plurality of panels comprising a front panel, a back panel, a first side panel, and a second side panel;

at least one bottom flap respectively foldably connected to a respective panel of the plurality of panels, the at least one bottom flap at least partially forming a closed bottom end of the carton; and a handle extending in at least the bottom end proximate the back panel; wherein at least a lower portion of the back panel extends in an oblique direction with respect to the bottom end;

the at least one bottom flap comprises a first side bottom flap foldably connected to the first side panel and a second side bottom flap foldably connected to the second side panel, the handle comprises a first handle portion in the first side bottom flap, a second handle portion in the second side bottom flap, a first handle opening disposed in the first handle portion of and a second handle opening disposed in the second handle portion, the first handle opening being generally aligned with the second handle opening.

2. The carton of claim 1, wherein the handle is disposed adjacent the lower portion of the back panel.

3. The carton of claim 1, wherein:

the handle portion of the at least one side bottom flap and the lower portion of the back panel at least partially define a handle recess in the carton.

4. The carton of claim 1, wherein:

the first side bottom flap and the second side bottom flap are at least partially overlapped with respect to one another to at least partially form the closed bottom end.

5. The carton of claim 4, wherein the at least one bottom flap further comprises a back bottom flap foldably connected to the lower portion of the back panel, the back bottom flap overlapping at least a portion of at least one of the first side bottom flap and the second side bottom flap.

6. The carton of claim 3, wherein the first side panel comprises a first triangular portion and the second side panel comprises a second triangular portion, the first triangular portion is foldably connected to the lower portion of the back panel and the first side panel, the second triangular portion is foldably connected to the lower portion of the back panel and the second side panel, and the handle recess is further defined by at least the first triangular portion and the second triangular portion, the first triangular portion and the second triangular portion being at least partially in face-to-face contact with the respective first side panel and the second side panel.

7. The carton of claim 6, wherein the first triangular portion is foldably connected to the lower portion of the back panel along a first fold line and the first side panel along a second fold line, and the second triangular portion is foldably connected to the lower portion of the back panel along a third fold line and the second side panel along a fourth fold line, the first fold line, the second fold line, the third fold line, and the fourth fold line extending obliquely with respect to the back panel and the bottom end of the carton.

8. The carton of claim 1, further comprising:

at least one top flap respectively foldably connected to a respective panel of the plurality of panels, the at least one top flap at least partially forming a closed top end of the carton; and a dispenser comprising at least a portion of the front panel and at least a portion of the top end of the carton.

9. The carton of claim 8, wherein the dispenser comprises a first oblique tear line extending in the first side panel, a second oblique tear line extending in the second side panel, a longitudinal tear line extending in the front panel, and at least one lateral fold line extending in the at least one top flap.

10. The carton of claim 8, further comprising a top handle extending in the closed top end of the carton.

11. A blank for forming a carton, the blank comprising:

a plurality of panels comprising a front panel, a back panel, a first side panel, and a second side panel;

at least one bottom flap respectively foldably connected to a respective panel of the plurality of panels, the at least one bottom flap being for at least partially forming a closed bottom end of the carton formed from the blank; and handle features in at least the at least one bottom flap for forming a handle extending in at least the bottom end proximate the back panel in the carton formed from the blank; wherein the at least one bottom flap comprises a first side bottom flap foldably connected to the first side panel and a second side bottom flap foldably connected to the second side panel;

the handle features comprise a first handle portion in the first side bottom flap, a second handle portion in the second side bottom flap, a first handle opening disposed in the first handle portion of the first side bottom flap, and a second handle opening disposed in the second handle portion of the second side bottom flap, at least a lower portion of the back panel is foldably connected to a remainder of the back panel along a longitudinal fold line and is foldable relative to a remainder of the back panel for being positioned to extend in an oblique direction with respect to the bottom end in the carton formed from the blank, and the handle formed from the handle features is disposed adjacent the lower portion of the back panel in the carton formed from the blank.

12. The blank of claim 11, wherein:

the handle portion of the at least one side bottom flap and the lower portion of the back panel are for at least partially defining a handle recess in the carton formed from the blank.

13. The blank of claim 12, wherein:

the first side bottom flap and the second side bottom flap are for being at least partially overlapped with respect to one another to at least partially form the closed bottom end in the carton formed from the blank.

14. The blank of claim 11, wherein the at least one bottom flap further comprises a back bottom flap foldably connected to the lower portion of the back panel, the back bottom flap being for overlapping at least a portion of at least one of the first side bottom flap and the second side bottom flap in the carton formed from the blank.

15. The blank of claim 12, wherein the first side panel comprises a first triangular portion and the second side panel comprises a second triangular portion, the first triangular portion is foldably connected to the lower portion of the back panel and the first side panel, the second triangular portion is foldably connected to the lower portion of the back panel and the second side panel, and the first triangular portion and the second triangular portion are for being positioned at least partially in face-to-face contact with the respective first side panel and the second side panel to further define the handle recess in the carton formed from the blank.

16. The blank of claim 15, wherein:

the first side panel is foldably connected to the back panel along a first lateral fold line, and the second side panel is foldably connected to the back panel along a second lateral fold line; and the first triangular portion is foldably connected to the lower portion of the back panel along the first lateral fold line and the first side panel along a first oblique fold line, and the second triangular portion is foldably connected to the lower portion of the back panel along the second lateral fold line and the second side panel along a second oblique fold line.

17. The blank of claim 11, further comprising:

at least one top flap respectively foldably connected to a respective panel of the plurality of panels, the at least one top flap being for at least partially forming a closed top end of the carton formed from the blank; and dispenser features extending in at least a portion of the front panel and at least a portion of the at least one top flap for forming a dispenser in the carton formed from the blank.

18. The blank of claim 17, wherein the dispenser comprises a first oblique tear line extending in the first side panel, a second oblique tear line extending in the second side panel, a longitudinal tear line extending in the front panel, and at least one lateral fold line extending in the at least one top flap.

19. A method of forming a carton comprising:

obtaining a blank comprising a plurality of panels comprising a front panel, a back panel, a first side panel, and a second side panel, at least one bottom flap respectively foldably connected to a respective panel of the plurality of panels, and handle features in at least the at least one bottom flap, the at least one bottom flap comprises a first side bottom flap foldably connected to the first side panel and a second side bottom flap foldably connected to the second side panel, the handle features comprise a first handle portion in the first side bottom flap, a second handle portion in the second side bottom flap, a first handle opening in the first handle portion, and a second handle opening in the second handle portion;

forming an interior of the carton at least partially defined by the plurality of panels, the forming the interior of the carton comprising forming an open-ended sleeve and positioning at least a lower portion of the back panel to extend in an oblique direction with respect to the bottom end; and positioning the at least one bottom flap to at least partially close a bottom end of the open-ended sleeve, the positioning the at least one bottom flap comprising positioning the handle features to form a handle adjacent the back panel, the positioning the handle features comprises aligning the first handle opening and the second handle opening.

20. The method of claim 19, wherein:

the at least one bottom flap comprises at least one side bottom flap foldably connected to at least one of the first side panel and the second side panel, the at least one side bottom flap comprising at least one handle portion;

the handle features comprise at least one handle opening in the at least one handle portion of the at least one side bottom flap; and the method further comprises forming a handle recess by folding at least a lower portion of the back panel to extend in an oblique direction with respect to the bottom end, the handle recess being defined by at least the lower portion of the back panel and the handle portion of the at least one side bottom flap.

21. The method of claim 20, wherein:

the first side panel comprises a first triangular portion and the second side panel comprises a second triangular portion, the first triangular portion being foldably connected to the lower portion of the back panel and the first side panel, the second triangular portion being foldably connected to the lower portion of the back panel and the second side panel; and the forming the handle recess further comprises positioning the first triangular portion and the second triangular portion at least partially in face-to-face contact with the respective first side panel and the second side panel so that the handle recess is further defined by at least the first triangular portion and the second triangular portion.

* * * * *